United States Patent [19]

O'Brien et al.

[11] 4,073,391

[45] Feb. 14, 1978

[54] SHEET JOGGER

[75] Inventors: John G. O'Brien, Darien; Franklin J. Calderazzo, New Canaan, both of Conn.

[73] Assignee: Pitney-Bowes, Inc., Stamford, Conn.

[21] Appl. No.: 726,108

[22] Filed: Sept. 24, 1976

[51] Int. Cl.[2] ..... B65H 31/34; B65H 33/08

[52] U.S. Cl. ..... 214/65; 214/6 N; 271/221; 271/246; 270/58

[58] Field of Search ..... 271/171, 221, 222, 224, 271/226, 233, 234, 236, 238–240, 242, 245, 246, 248, 253, 255; 214/6 S, 6 N; 270/53, 58

[56] References Cited

U.S. PATENT DOCUMENTS

| | | | |
|---|---|---|---|
| 1,580,564 | 4/1926 | Novick | 271/233 |
| 3,172,656 | 3/1965 | Mestre | 271/238 |
| 3,502,255 | 3/1970 | Hermann et al. | 271/222 X |
| 3,627,312 | 12/1971 | Fackler | 271/221 |
| 3,637,203 | 1/1972 | French | 271/246 |
| 3,972,525 | 8/1976 | Foster et al. | 271/221 |

*Primary Examiner*—Robert W. Saifer
*Attorney, Agent, or Firm*—Thomas R. FitzGerald; William D. Soltow, Jr.; Albert W. Scribner

[57] ABSTRACT

A sheet jogger to justify and align a stack of sheets into a registered bundle which is subsequently discharged into a bin. Prior to discharging of the bundle, the stack of sheets can be stapled. Each bundle is offset from every other bundle when discharged into the bin. Sheets are fed onto a jogging deck by at least one conveyor roller to abut against at least one gate finger at the end of the jogging deck. A back jogger aligns the sheets into registration against the gate finger and a left side jogger assembly jogs the sheets into alignment against a right side jogger assembly. The gate fingers drop down and a lower eject roller rises above the jogging deck to engage a bottom sheet off the stack thereby engaging the stack against an upper fixed pressure roller. On the next jogging operation, the initial jogging operation is repeated and the left side guide assembly and right side guide assembly return to a rest position prior to ejection of the aligned bundle thereby offsetting the ejected bundle a distance equal to travel of the front side guide assembly. All mechanical jogging operations are controlled by a cylindrical control means having an axial curved circular detented jogger cam supported on a radial detented hub mounted below the jogging deck. A stapler and corresponding anvil mounted on the jogging deck can staple each aligned justified bundle of sheets together.

18 Claims, 31 Drawing Figures

FIG. 5
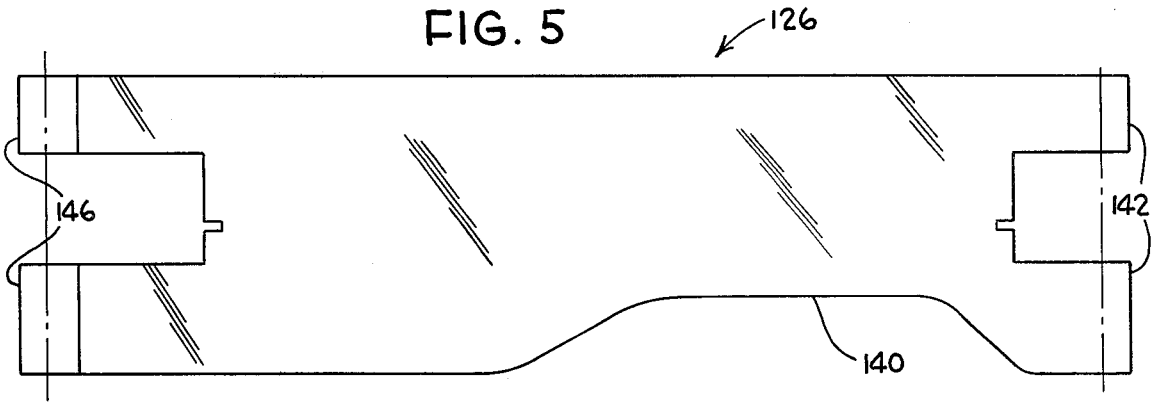
FIG. 4
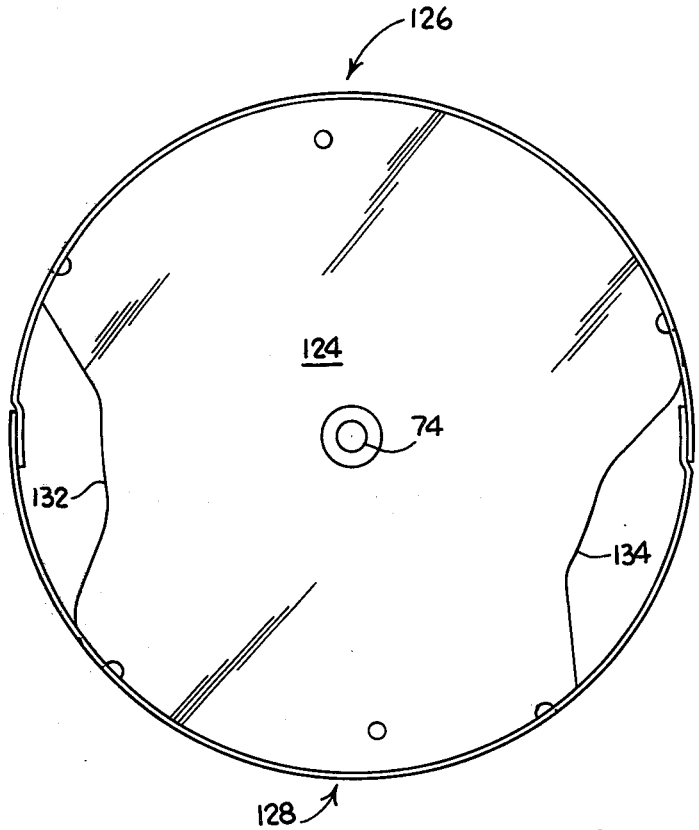
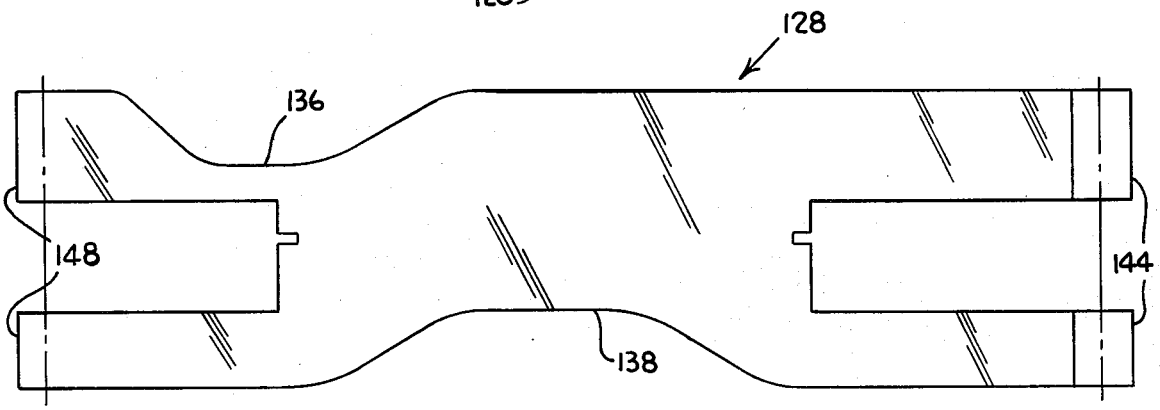
FIG. 6

FIG. 7a
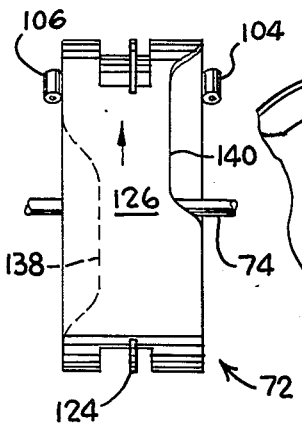
FIG. 7b
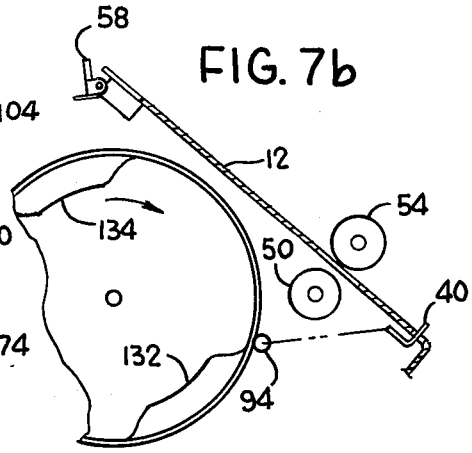
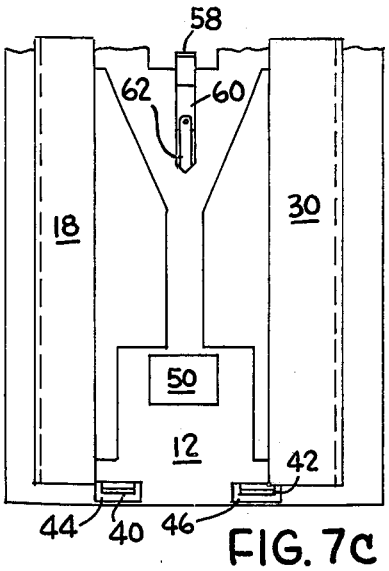
FIG. 7c
FIG. 8a
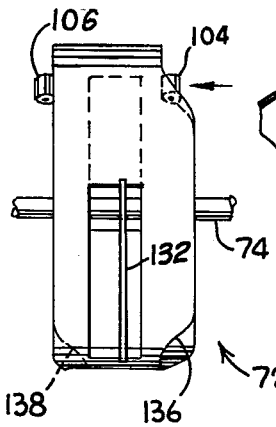
FIG. 8b
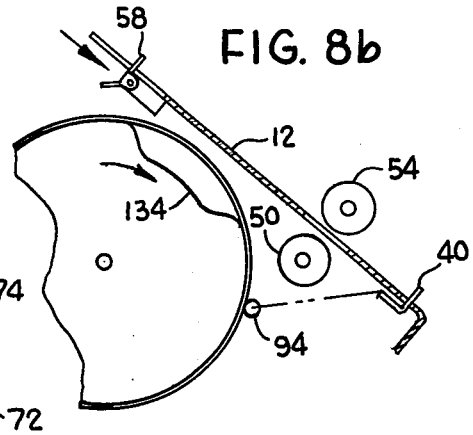
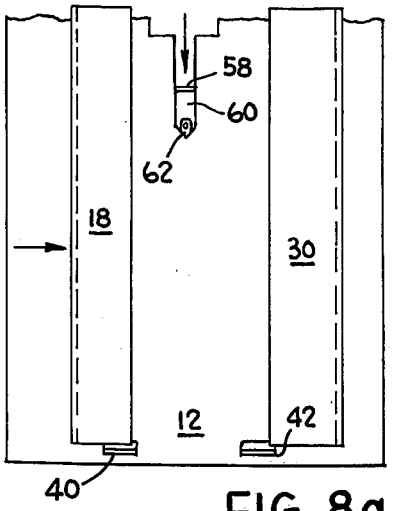
FIG. 8c
FIG. 9a
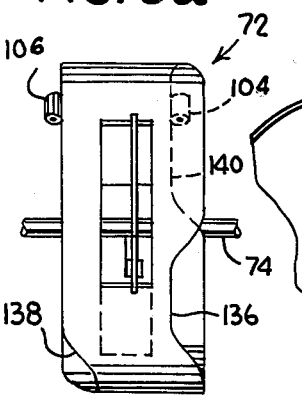
FIG. 9b
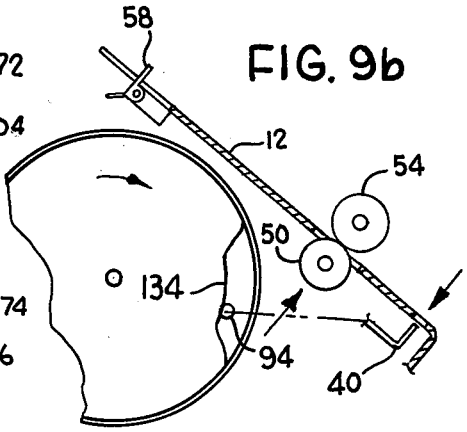
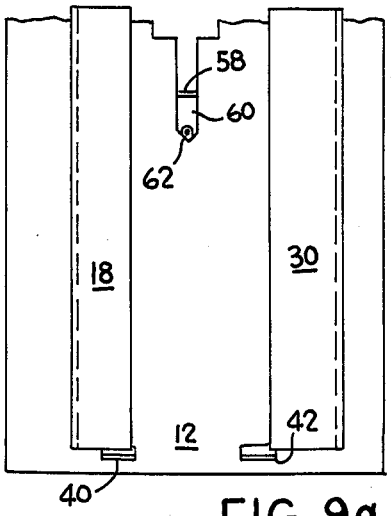
FIG. 9c FIG. 10a
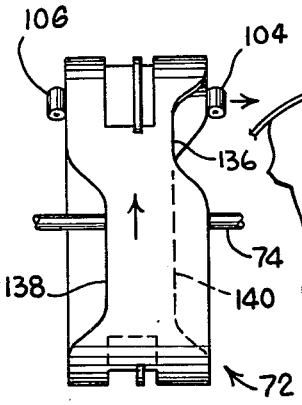
FIG. 10b
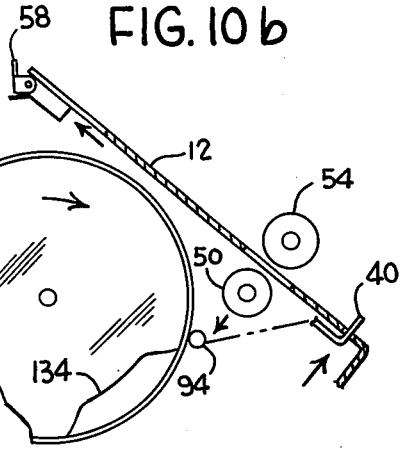
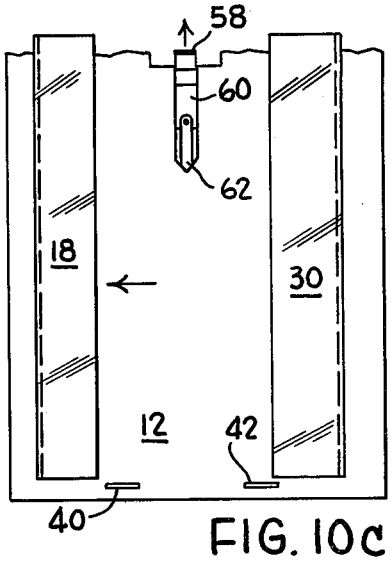
FIG. 10c
FIG. 11a
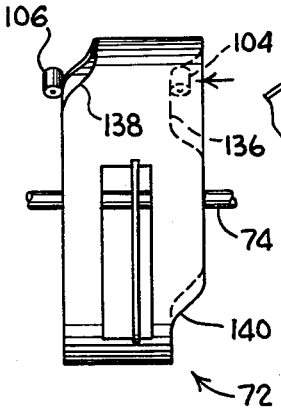
FIG. 11b
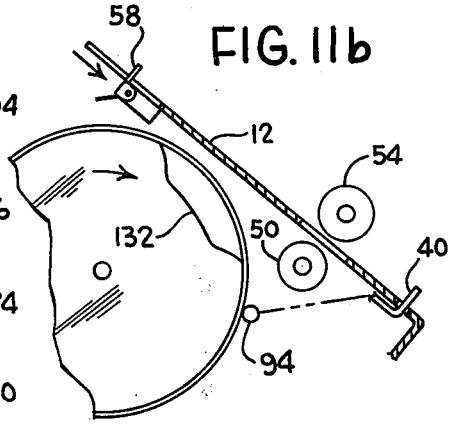
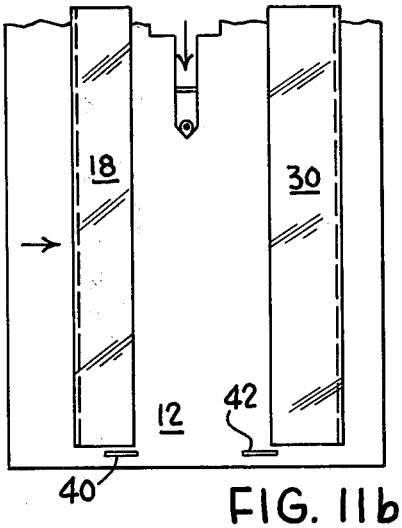
FIG. 11b
FIG. 12a
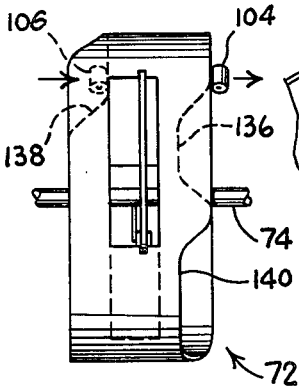
FIG. 12b
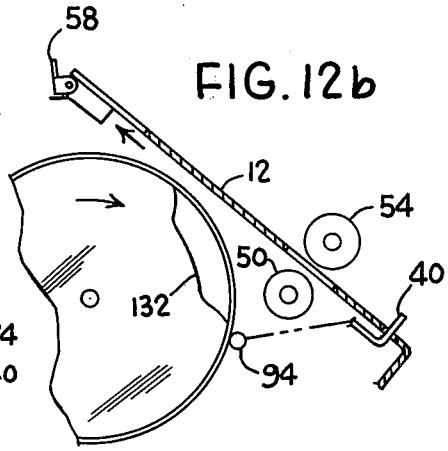
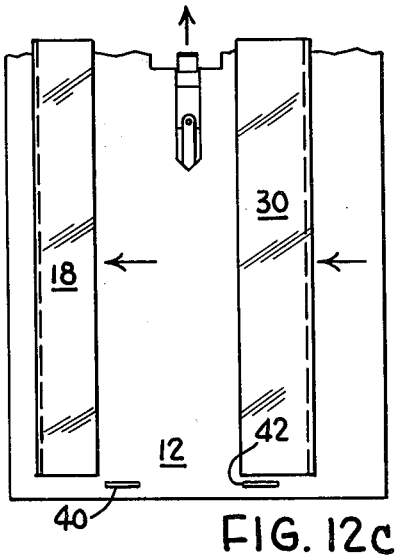
FIG. 12c FIG. 13a
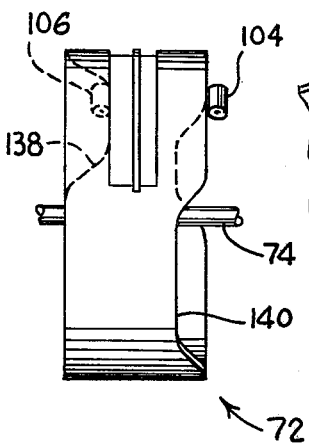
FIG. 13b
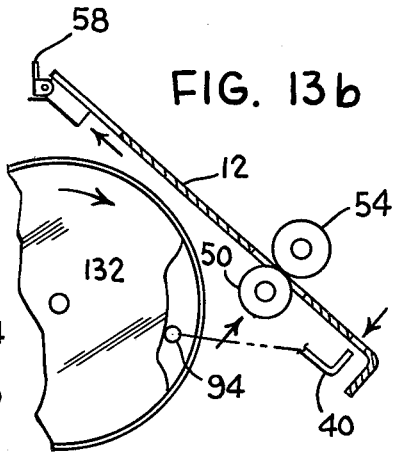
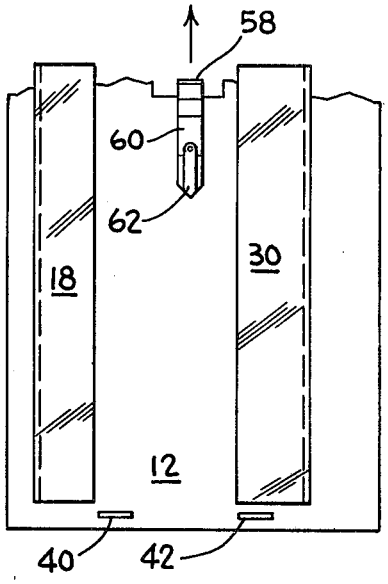
FIG. 13c
FIG. 14c
FIG. 14a
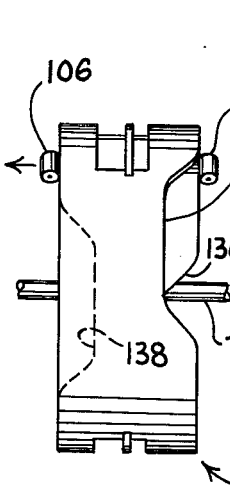
FIG. 14b
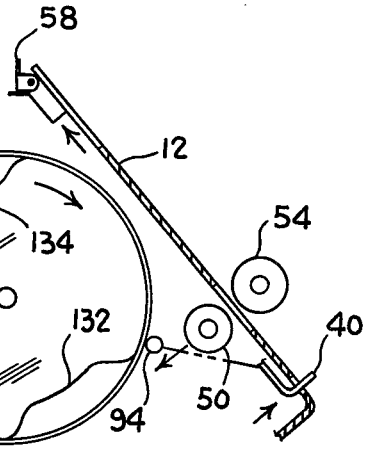
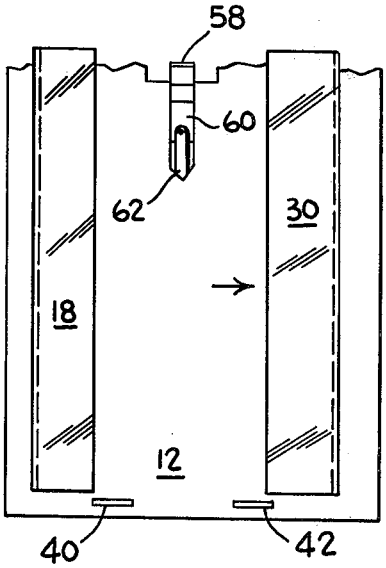

SHEET JOGGER

BACKGROUND OF THE INVENTION

1. Field of the Invention

The present invention relates to a sheet jogger for registering the edges of a stack of sheets into an aligned justified bundle, elective stapling each bundle of sheets, and elective offsetting each ejected bundle from the other into a discharge bin.

2. Description of the Prior Art

In the field of sheet joggers, it has been a general practice to utilize joggers which are large complex mechanical structures to register edges of a stack of sheets thereby forming an aligned justified bundle. The prior art sheet joggers usually have mechanical structure which requires and consumes considerable amounts of floor space in addition to presenting safety hazards to the operator from moving mechanical components during sheet jogging operations.

During sheet jogging operations, it is difficult to remove a sheet jam or misaligned bundle in a sheet jogger which might occur during registration of sheet edges prior to an elective stapling operation preceeding offset discharge into a storage bin. Removal of a paper jam usually requires mechanical component disassembly to a certain degree of the sheet jogger to extract jam or misaligned sheets of a stack from the mechanical jogging structure on the jogging deck and then reassembly is required prior to again beginning sheet jogging operations.

Also, sheet joggers usually do not permit simple and quick adjustment to the mechanical structure to allow for different lengths or widths of paper without possible complex and time consuming adjustments to the mechanical jogging structure if such are even permissible. Further, some past prior art sheet joggers have inherent noise factor problems during operation of the mechanical machines presenting a high noise decibal factor to the degree of possibly being dangerous to the operator's hearing and personal surrounding. For these reasons, prior art sheet joggers have certain inherent mechanical limitations and deficiencies yielding less than satisfactory registration of sheets.

Mestre, U.S. Pat. No. 3,172,656 issued on Mar. 9, 1965, discloses a sheet jogging mechanism for precisely aligning a plurality of sheets to bring them into precise lateral and longitudinal alignment. The sheets are brought into approximate end to end alignment against stops by a conveyor belt system. While the sheets are halted against the stops, jogging to bring a group of sheets into registration of an aligned justified bundle takes place followed by stapling. After stapling, the conveyor belt system carries the stapled group of sheets to a deposit platform. A jogging mechanism is provided to determine if one or more sheets are missing; and if such occurs, the stapled group of sheets is carried to a rejection bin. This invention jogs sheets into registration using simplicity of mechanical structure and operation.

SUMMARY

The general purpose of this invention is to provide a simple yet mechanically reliable sheet jogger to register a stack of sheets into an aligned justified bundle which can be subsequently stapled if so elected, and then ejected into a discharge bin with each ejected aligned justified bundle being offset from the preceeding discharged bundle, if so elected. All jogging, stapling, and eject operations are controlled by a single curved detented cam surface on a detented hub which is rotatably mounted below the inclined jogging deck.

The preferred embodiment of the present invention is a sheet jogger having at least one conveyor roller at a top end of an inclined jogging deck which conveys sheets down onto the inclined sheet jogging deck to slide down with gravitational assistance and abut against at least one gate finger at a lower end of the jogging deck. A back jogger at the upper end of the jogging deck mounted to reciprocate in a slot in the jogging deck and to move in a slide retainer below the jogging deck forces the lateral edges of the sheets into registration against the gate finger. A left side guide assembly jogs the longitudinal edges of the stack of sheets into registered engagement against a right side guide assembly to form an aligned justified bundle of sheets. Subsequently, a lower eject roller rises upward in a center portion of and above the jogging deck to engage a bottom most sheet of the aligned justified bundle of sheets thereby forcing upwardly the stack of sheets into engagement against an upper pressure roller rotatably mounted to a fixed bracket. Rotation transferred to the lower eject roller transfers eject motion to the aligned justified bundle to eject it into a discharge bin located at the lower end of the jogging deck. During the next jogging operation and after the left side guide assembly jogs the longitudinal edges of the stack into engagement against the right side guide assembly to form the aligned justified bundle of sheets, both the left side guide assembly and right side guide assembly move towards the left side of the jogging deck prior to discharge of the jogged sheets to offset the aligned justified bundle of sheets being ejected into the discharge bin from the previously ejected aligned justified bundle of sheets in the discharge bin.

A significant feature and aspect of the invention is that all mechanical operations are controlled by cylindrical control means having a curved circular detented cam jogger supported by a detented hub affixed to a cam jogger shaft. Cam followers ride the axial curved detented edges of the circular cam jogger surface which respectively controls the jogging of the left side guide assembly towards the right side guide assembly in addition to controlling the offsetting of a discharged bundle of sheets where the left side guide assembly and right side guide assembly move in tandem towards the left of the jogging deck for every other discharge of a justified aligned bundle of sheets. The back jogger is linked to the left side cam follower by a rocker arm, link, and slide to operate simultaneously with the front side guide assembly. An additional cam follower rides the radial circular cam jogger surface having cutaway portions forming a detended hub which controls the lowering of the gate finger below the jogging deck and simultaneously raising the lower eject roller above the jogging deck.

Having briefly described the preferred embodiment of the invention, it is a principal object thereof to provide a new and improved sheet jogger for registering a stack of sheets into a justified aligned bundle, stapling the bundle of sheets if so desired, and offsetting every other bundle of sheets upon ejection into a discharge bin if so elected.

An object of the present invention is to provide a sheet jogger which jogs and registers the longitudinal edges and lateral edges of a stack of sheets into a justified aligned bundle.

Another object of the present invention is to provide mechanical adjustments in the sheet jogging deck of the sheet jogger to accommodate stacks of sheets having varying lateral widths and varying longitudinal lengths. Adjustment for the lateral width of sheets and adjustment for the longitudinal length of sheets is performed from the top of the jogging deck.

A further object of the invention is to provide a gate finger actuator to actuate the gate below the jogging deck to remove a justified aligned bundle of sheets which have been jogged into registration prior to stapling or discharge. The gate fingers can be pushed downwardly below the holes in the jogging deck by depressing the gate actuator to allow an operator to insert his hand to remove a registered bundle of sheets at the lower end of the jogging deck from between the front and rear side guide assemblies.

Still another object is to provide a single mechanical element to control all jogging, stapling, eject, and offsetting functions. The single mechanical element, a jogger cam, allows for simplified mechanical operation of the sheet jogger using a least number of mechanical components for reliability and simplicity of sheet registering and jogging operations.

A still further object is to offset every other justified aligned bundle of sheets ejected from the jogging deck into the discharge bin from the previous discharge bundle.

BRIEF DESCRIPTION OF THE DRAWINGS

Other objects and many of the attendant advantages of this invention will be readily appreciated if the same becomes better understood by reference to the following detailed description when considered in connection with the accompanying drawings, in which like reference numerals designate like parts throughout the figures thereof and wherein

FIG. 4 illustrates a side view of the jogger cam;

FIG. 5 illustrates a flat elongated view of the first curved half of the jogger cam;

FIG. 6 illustrates a flat elongated view of the second curved half of the jogger cam;

FIGS. 7*a*, 7*b*, and 7*c* illustrate an end view of the jogger cam, a side view of the sheet jogger, and a top view of the sheet jogger respectively in a home position prior to beginning sheet jogging operations;

FIGS. 8*a*, 8*b*, and 8*c* illustrate a sheet jogging operation with the left side guide assembly jogging toward the right side guide assembly;

FIGS. 9*a*, 9*b*, and 9*c* illustrate the sheet jogger in an ejecting operation;

FIGS. 10*a*, 10*b* and 10*c* illustrate the sheet jogger returning to the home position after a first sheet jogging operation and partial revolution of the jogger cam;

FIGS. 11*a*, 11*b*, and 11*c* illustrate the sheet jogger in a second jogging operation during a partial revolution of the jogger cam;

FIGS. 12*a*, 12*b*, and 12*c* illustrate the sheet jogger offsetting a justified aligned bundle of sheets prior to ejection;

FIGS. 13*a*, 13*b*, and 13*c* illustrate the sheet jogger ejecting an offset justified aligned bundle of sheets;

FIGS. 14*a*, 14*b*, and 14*c* illustrate the sheet jogger returning to a home position after a complete revolution of the jogger cam, and;

DESCRIPTION OF THE PREFERRED EMBODIMENTS

Figure 1:
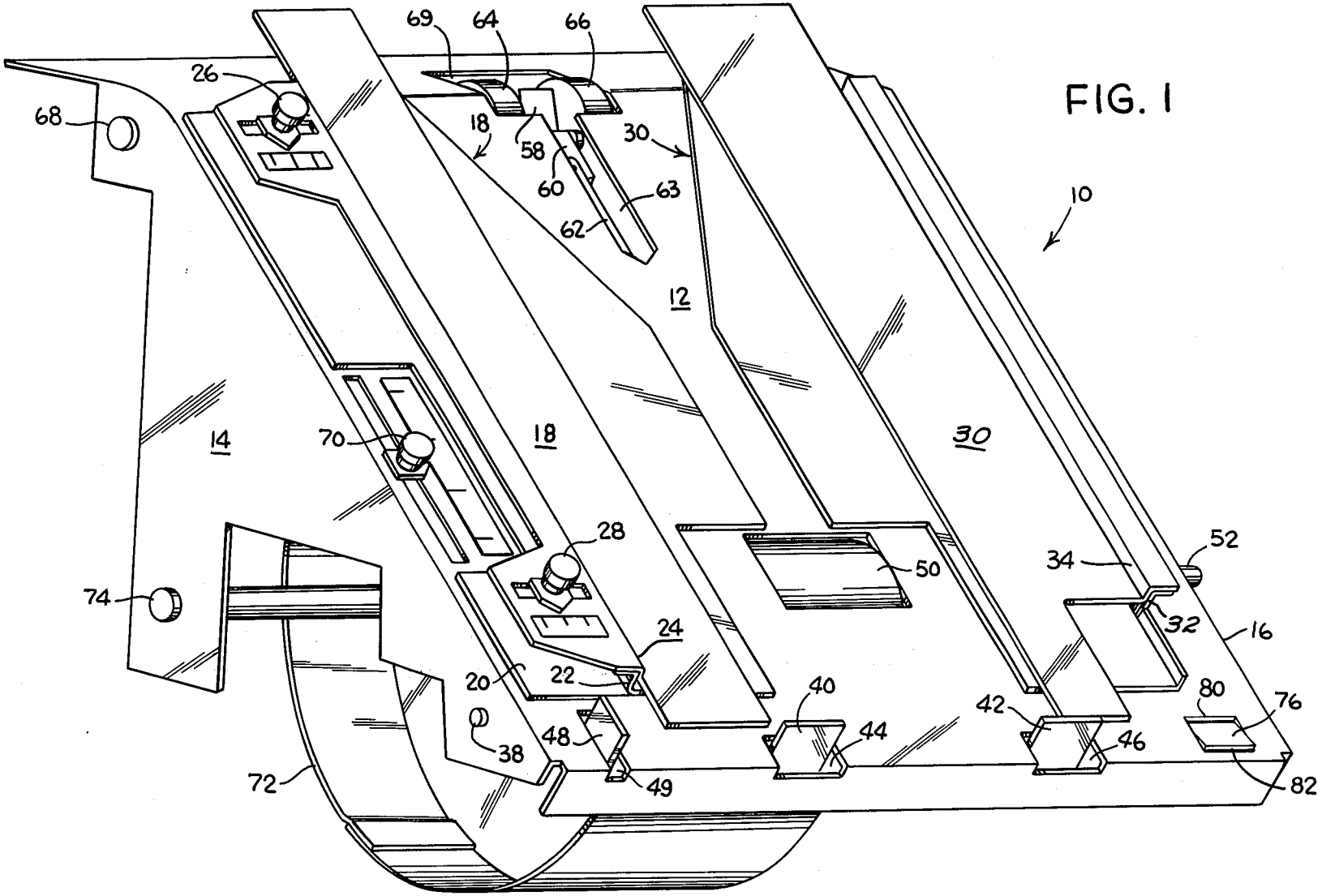
FIG. 1 illustrates a preferred embodiment of the sheet jogger showing a top perspective view of the invention.
Figure 2:
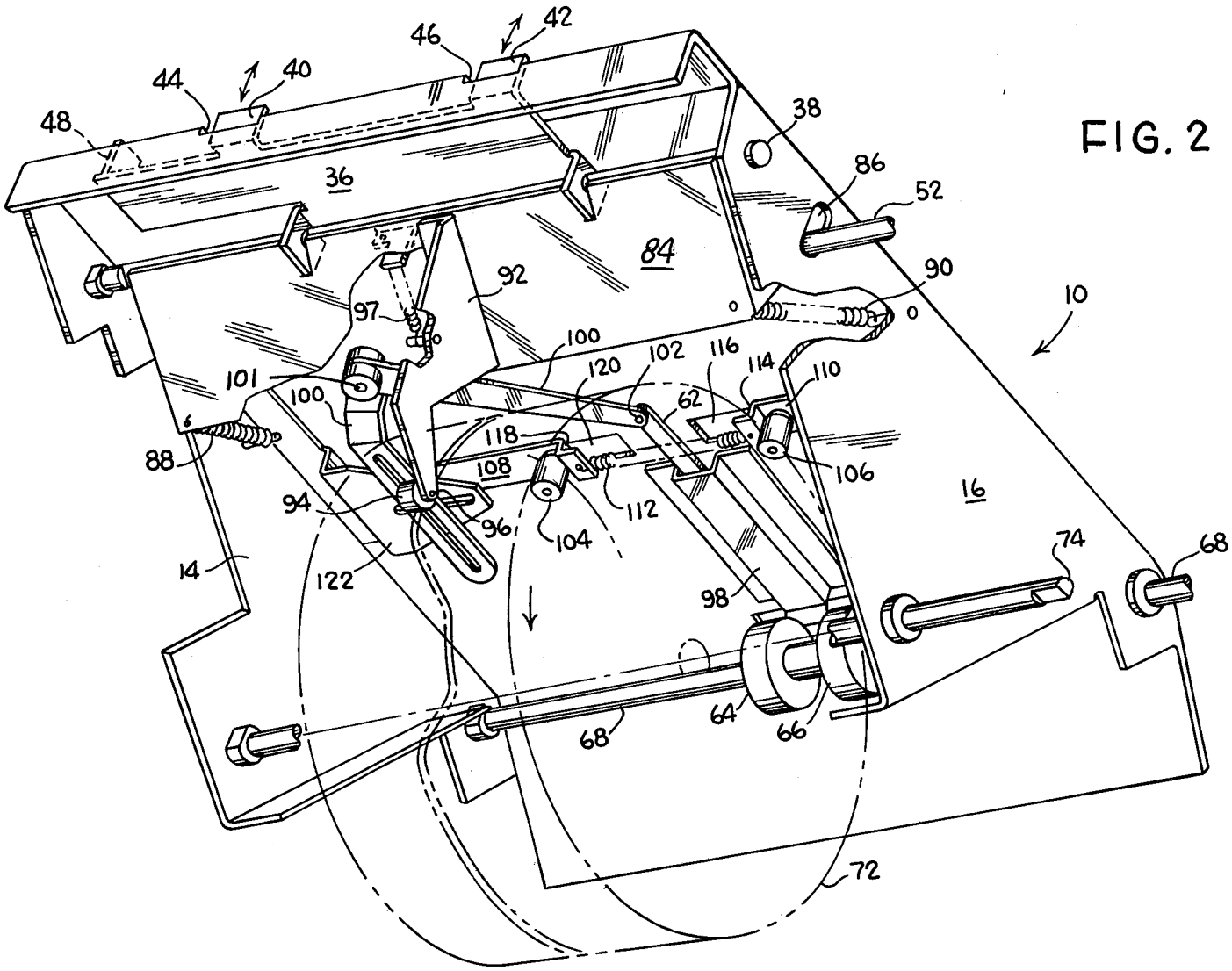
FIG. 2 illustrates a bottom perspective view of the invention.

FIG. 1 illustrates a preferred embodiment showing a top perspective view of a sheet jogger 10 having a sheet jogging deck 12, a left side 14, and a right side 16 which is shown in FIG. 2. Left side guide assembly 18 having a plate 20, a lower front "Z" portion 22 and an upper front "Z" portion 24 affixes to the plate 20 which is slidably mounted at the left side 14 of the jogging deck 12 and is described in later detail. Thumb screws 26 and 28 limit the degree of lateral movement of the left side guide assembly 18 to accommodate different widths of sheets in the range of 8 to 8¾ inches. Right side guide assembly 30 having a lower rear "Z" portion 32 affixed to an upper front "Z" portion 34 is slidably mounted at the right side 16 of the jogging deck 12 which is described in later detail. A gate 36 shown in FIG. 2 is axially mounted below the lower end of jogging deck 12 to a gate shaft 38 which is rotatably mounted between the left side 14 and the right side 16 in oil impregnated bearings and secured with E washers. Gate fingers 40 and 42 attach to the gate shaft 38 and extend through holes 44 and 46 respectively of the jogging deck 12. A gate actuator 48 attaches to the gate shaft 38 and extends through a hole 49 of the jogging deck 12 near the left side 14. A lower eject roller 50 is affixed to an axially rotatably eject roller shaft 52 which is described in later detail. An upper eject roller not shown is axially mounted to a fixed bracket by any well known method. A back jogging finger 58 at the upper end of the jogging deck 12 attaches to a slide 60 which attaches to a link 62 and moves in a longitudinal slot 63 which is described in later detail. Conveyor exit rollers 64 and 66 are axially affixed to shaft 68 and rotatably mounted in a lateral slot 69 between the left side 14 and the right side 16 in oil impregnated bearings and secured with E washers. A thumb screw 70 adjusts the degree of longitudinal movement of back jogger 58 to accommodate different lengths of sheets in the range of 10 to 11¾ inches. A curved circular detented jogger cam 72 affixes to jogger cam shaft 74 which is rotatably mounted between the left side 14 and the right side 16 in oil impregnated bearings and E washers. A staple anvil 76 affixes to the lower end of the right side 16 of jogger deck 12 so that a leading edge 80, is recessed into the jogging deck 12 and a trailing edge 82 is above the jogging deck 12. This permits sheets to slide over the leading edge 80 of staple anvil 76 during an ejection operation.

FIG. 2 illustrates a bottom perspective view of the sheet jogger 10 showing the gate 36 attached to the axially mounted shaft 38, the gate fingers 40 and 42 extending through the holes 44 and 46 at the lower end of jogging deck 12, and the gate actuator 48 shown in imaginary lines. The conveyor exit rollers 64 and 66 are shown on the shaft 68. The jogger cam 72 affixes to axially mounted jogger cam shaft 74.

An eject roller bracket 84 is affixed to the gate shaft 38. The eject roller shaft 52 is rotatably mounted in oil impregnated bearings and affixed to sides of eject roller bracket 84 by E washers. One end of the eject roller shaft 52 extends out the right side 16 through an oblong hole 86. Springs 88 and 90 attach from the corner ends of eject roller bracket 84 to tension points on the inside of the respective left side 14 and the right side 16. Eject and gate follower bracket 92 is permanently affixed to the eject roller bracket 84 and carries eject and gate cam follower 94 which is rotatably mounted and secured to a shaft 96. A spring 97 biases the eject and gate follower bracket 92 in a direction toward the gate 36. A slide retainer 98 is fixedly secured to the underside of the jogging deck 12 to enclose and overlap the slot 63 in the jogging deck 12 in addition to slidably retaining the back jogger 58, the slide 60 and the link 62 which overlap the width of the slot 63. A rocker arm 100 attaches to the link 62 by a moving pivot point 102. Cam followers 104 and 106 attach respectively to cam follower supports 108 and 110. Spring 112 biases cam follower supports 108 and 110 together. A plastic slide 114 of slightly greater thickness than the jogging deck 12 and accommodated by a rectangular hole 116 of a slightly larger width and greater length spaces the cam follower support 110 from the lower rear "Z" portion 32 of the right guide assembly 30. A plastic slide guide 118 likewise accommodated in a rectangular hole 120 spaces the cam follower support 108 from the plate 20 of the left side guide assembly 18. An adjusting bracket 122 fits between the rocker arm 100 rotatably mounted about a fixed pivot point 101 and the cam follower support 108 which is threaded to receive the thumb screw 70. A pivot pin not shown in the figure ties the adjusting bracket 122, the cam follower support 108, and the rocker arm 100 into a common pivot point so that link 62 will reciprocally move back jogger 58 as cam follower support 108 is laterally moved by cam 104.

Figure 3:
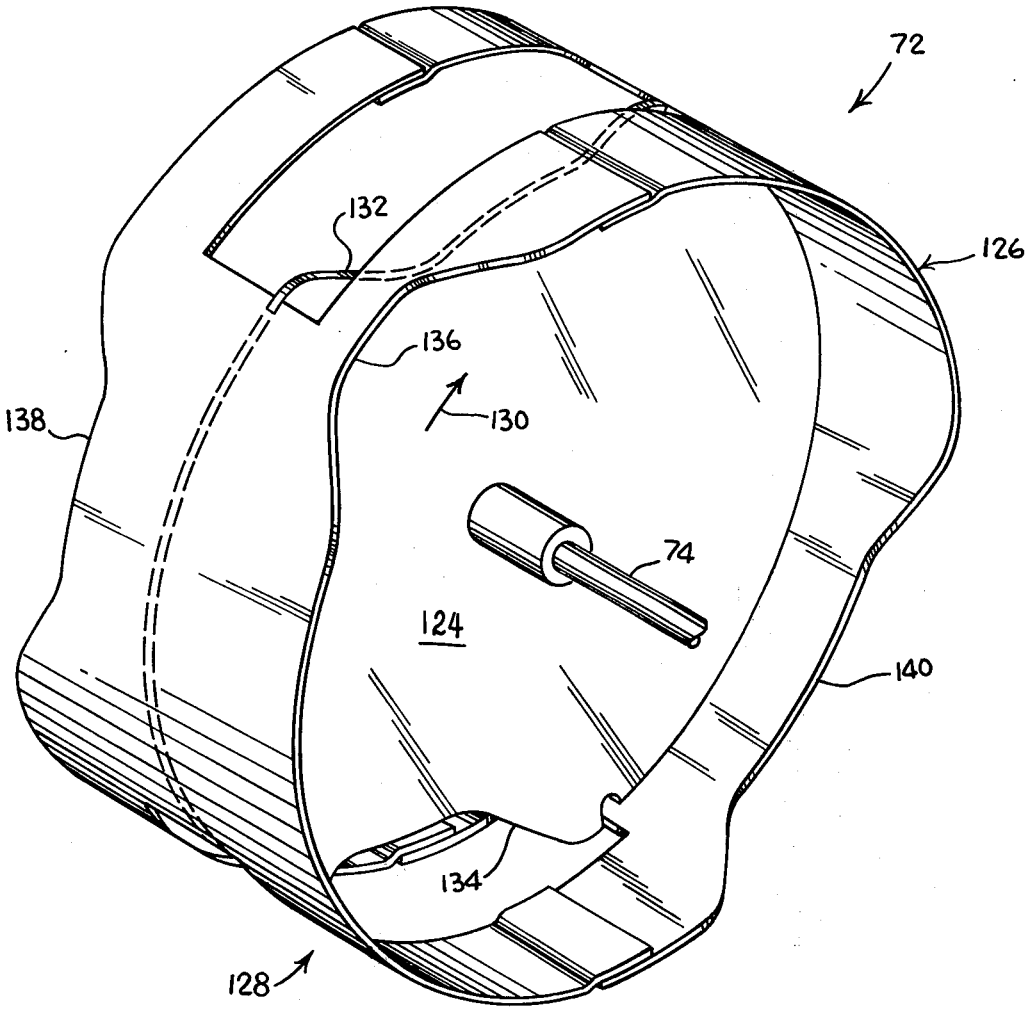
FIG. 3 illustrates an isometric view of the cylindrical jogger cam of the invention.

FIG. 3 illustrates an isometric view of the curved circular detented jogger cam 72 affixed to the jogger cam shaft 74. Cam 72 consists of a radial detented hub 124, a first axial curved half 126, and a second axial curved half 128. Arrow 130 indicates clockwise rotation of the cam 72 in FIG. 1. A first detent 132 accepts cam follower 94 to eject sheets having been jogged to the left side 14. A second detent 134 accepts cam follower 94 to eject sheets having been jogged to the right side 16. Detents 136 and 138 are in the second curve half 128 and the detent 140 is in the first curve half 126 which operation will be described in later detail.

FIG. 4 illustrates a side view of the jogger cam 72 affixed to the jogger cam shaft 74 showing the cam follower eject detents 132 and 134.

FIGS. 5 and 6 illustrate flat elongated views of the first axial curve half 126 and the second axial curve half 128 respectively of the jogger cam 72. End 142 of FIG. 5 mates to and overlaps end section 144 of FIG. 6 and likewise, end 146 of FIG. 5 mates to and overlaps end 148 of FIG. 6 to form the curved circular detended jogger cam 72.

PREFERRED MODE OF OPERATION

FIGS. 7–14 illustrate the preferred mode of operation of the sheet jogger 10 through one entire revolution of the jogger cam 72. Associated with each figure numeral are three alphabetical figures corresponding to three separate individual drawings to illustrate the distinct operation of the jogger cam 72 and the cam followers 104 and 106 (letter "*a*" illustrating an end view of the jogger cam); the gate 40 and 42, the back jogger 58, the eject roller 50; and, the cam follower 94 (letter "*b*" illustrating a side view of the sheet jogger); and the left side guide assembly 18, the right side guide assembly 30, the gate fingers 40 and 42, and the back jogger (letter "*c*" illustrating a top view of the sheet jogger).

FIGS. 7*a*, 7*b*, and 7*c* illustrate the sheet jogger 10 prior to beginning a sheet jogging operation in a home position. FIG. 7*a* shows an end view of the jogger cam 72 fixed to the jogger cam shaft 74 in a home position with the left side cam follower 104 and the right side cam follower 106 equally spaced apart from the hub 124. Cam follower eject detent 132 is positioned at the bottom of the jogger cam 72 and the cam follower eject detent 134 is positioned at the top of the jogger cam 72. FIG. 7*b* illustrates a side view of the gate fingers 40 and 42 (not shown) extending upright through holes 44 and 46 (not shown). The eject roller 50 and eject pressure roller 54 are equally separated from the bottom and top respectively of the jogging deck 12. The back jogger 58, the slide 60, and the link 62 (not shown) are positioned towards the top of the jogging deck 12 so that the back jogger 58 falls down out of the slide guide 98 (not shown) below the jogging deck 12 by force of gravity. The cam follower 94 rests on the first curved half 126 of the jogger cam 72. FIG. 7*c* shows a top view of the sheet jogger 10 showing the sheet jogger deck 12, the left side guide assembly 18 in a home position, the right side guide assembly 30 in a home position, the fingers 40 and 42 extending upwardly through holes 44 and 46, the back jogger 58 extending out of slide 98 (not shown) below the sheet jogging deck 12, and the ejector roller 50 below the sheet jogging deck 12.

FIGS. 8*a*, 8*b*, and 8*c* illustrate a sheet jogging operation with the left side assembly 18 jogging towards the right side guide assembly 30 of the sheet jogger 10 wherein the jogger cam 72 has begun to turn clockwise. FIG. 8*a* shows left side cam follower 104 having been pulled into the jogging detent 140 by the spring 112 (not shown). At the bottom of the jogger cam 72, the cam follower eject detent 132 is now in full view and the jogging detents 136 and 138 have rotated into partial view of the plane of the drawing. FIG. 8*b* shows the back jogger 58 being pulled towards the gate fingers 40 and 42 (not shown) by the slide 60 to jog and register the sheets against the gate fingers. The back jogger 58 is pulled down into the slide guide 98 (not shown) and upwards by its action against slide guide 98 through cooperation of slide 60 attached to link 62 which attaches to rocker arm 100 by way of a moving point determined by thumb screw 70 that attaches rocker arm 100 to cam follower support 108 which is in turn coupled to carry cam follower 104. In the down stroke, the jog position, the back jogger can be adjusted to accomodate length of sheets from 10 inches to 11¾ inches by thumb screw 70. Thumb screws 26 and 28 are used to adjust the front side guide assembly 18 to accomodate different widths of sheets. FIG. 8*c* shows the left side guide assembly 18 moving over on the jogging deck 12 towards the right side guide assembly 30, and the back jogger 58 moving downwardly toward the gate fingers 40 and 42 extending upwardly through the holes 44 and 46 to jog the sheets into an aligned justified stack of sheets.

FIGS. 9*a*, 9*b*, and 9*c* illustrate the sheet jogger 10 in an ejecting operation of a first justified aligned stack of sheets. FIG. 9*a* shows the cam follower 104 still in the cam follower jogging detent 140 shown in imaginary lines, and the cam follower 94 is now engaged in the cam follower eject detent 134. FIG. 9*b* shows the gate finger 40 and 42 (not shown) are being reciprocated below the jogging deck 12 through action of the cam follower 94 which is spring biased into the cam follower eject detent 134 of the jogger cam 72. Through the same action of the cam follower 94, the eject roller 50 is reciprocated above the jogging deck 12, and while rotating, ejects a justified aligned bundle of sheets down the inclined sheet jogging deck 12. By acting against the bottom sheet of the aligned stack which is engaged against the upper eject pressure roller 54, the stack is propelled down off of and away from the sheet jogging deck 12 and the back jogger 58 respectively. The ejection operation of FIG. 9*b* is illustrated in more detail in FIG. 15 showing the ejection operation of the lower eject roller 50, and the gate fingers 40 and 42 (not shown) being biased below the jogging deck 12.

Figure 15:
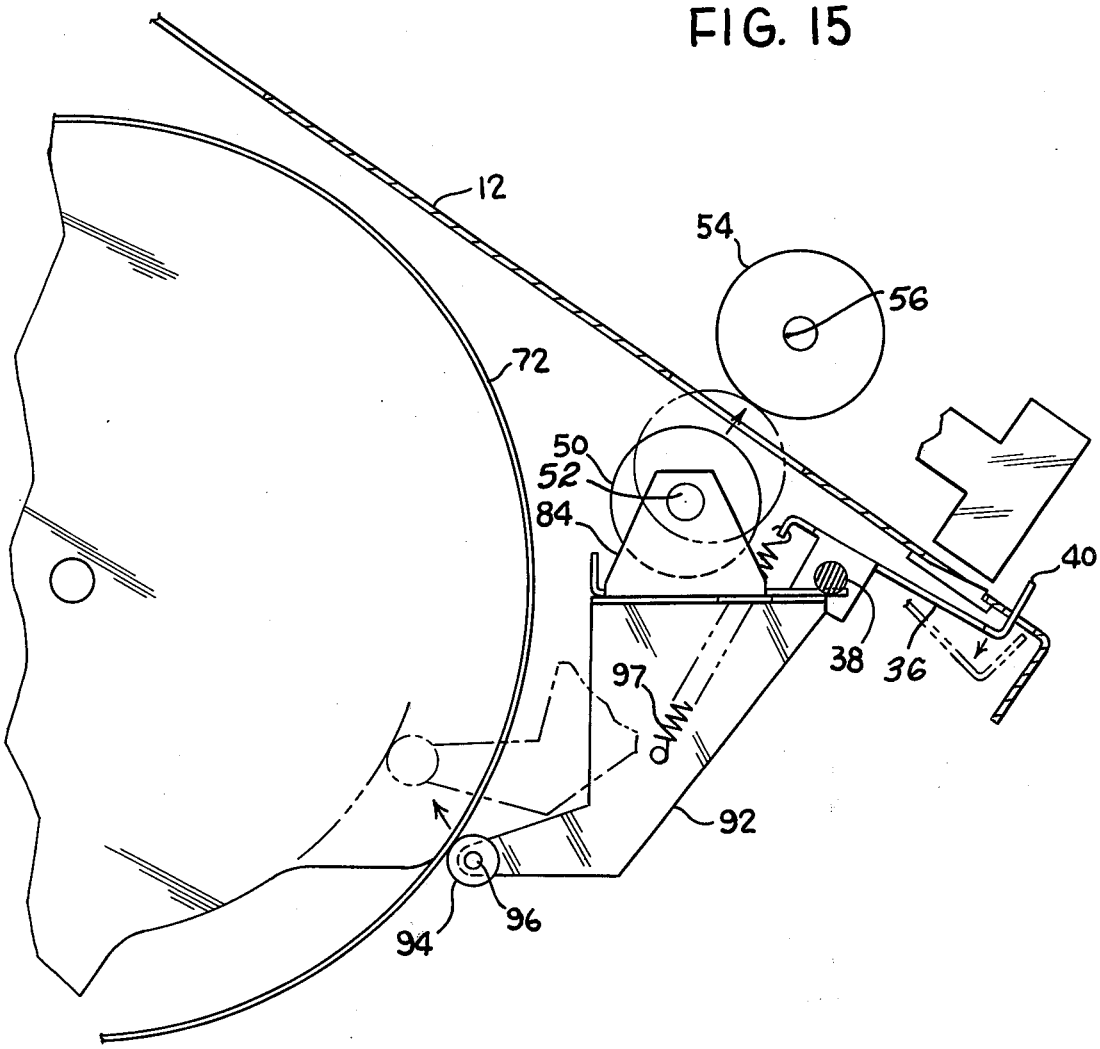
FIG. 15 illustrates a side view of the operation of the hub cam follower, gate finger, and lower eject roller during an ejection operation.

FIG. 15 illustrates the operation of the cam follower 94, the gate fingers 40 and 42, the lower eject roller 50, and the upper eject pressure roller 54 on the sheet jogging deck 12 of the sheet jogger 10. During a sheet jogging operation, the cam follower 94 rotatably mounted on the shaft 96 to the eject follower bracket 92 rides against the curved halves 126 and 128 of the jogger cam 72. The eject roller bracket 84 carries the lower eject roller 50 rotatably affixed to the shaft 52 which is driven accordingly and is also attached to the eject follower bracket 92. The eject roller bracket 84 and the eject follower bracket 92 are fixedly secured to the gate shaft 38. The gate 36 carrying the gate fingers 40 and 42 in addition to the gate actuator 48 is rotatably mounted on the gate shaft 38 and is spring biased to the eject follower bracket 92 which allows independent movement of the gate 36 carrying the gate fingers 40 and 42 with respect to the eject follower bracket 92. The cam follower 94 carried on the eject follower bracket 94 which is spring biased to be pulled into the cam follower eject detent 132 and 134 of the hub 126 on rotation of the jogger cam 72 as shown in imaginary lines. This rotating action around the gate shaft 38 results in the lower eject roller 50 being biased upwardly as shown in the imaginary lines above the jogging deck 12 in addition to bringing the gate 36 carrying the gate fingers 40 and 42 downwardly below the jogging deck 12. At the same time, the lower eject roller 50 moves upwardly above the jogging deck 12. The lower eject roller 50 is driven by rotation through shaft 52 to act against the bottommost sheet of the stack. The stack of sheets is biased against the upper eject roller 54 which is rotatably secured to the shaft 56 thereby propelling the justified aligned bundle of sheets downwardly off of the inclined jogging deck 12. As the jogger cam 72 further rotates clockwise, the cam follower 94 rides the hub out of the cam follower eject detent 132 thereby bringing the lower eject roller 50 and the gate 36 carrying gate fingers 40 and 42 to a home position as is shown in solid lines with the cam follower 94 again riding against curved section 128. The same rotating action is repeated on a second jogging operation when the cam follower 94 is pulled into cam follower eject detent 134 towards the end of a revolution of the jogger cam 74.

FIGS. 10*a*, 10*b*, and 10*c* illustrate the sheet jogger 10 returning to a home position after a first sheet jogging operation after a partial revolution of the jogger cam 72. FIG. 10*a* shows the cam follower 104 which has risen out of the cam follower jogging detent 140 and which is now equally space apart from the cam follower 106 on the hub 124 of the jogger cam 72. FIG. 10*b* shows the gate fingers 40 and 42 (not shown) which have risen upwardly shown by the arrow through holes 44 and 46 (not shown), lower eject roller 50 pulled downwardly away from the jogging deck 12, and the back jogger 58 folded down below the jogging deck 12 after being pushed out of slide 98 through action of the slide 60, the link 62 and the rocker 100. The cam follower support 108 carrying cam follower 104 causes the back jogger 58 to fall down away from sheet jogging deck 12 by gravity. FIG. 10*c* shows the left side guide assembly 18 moved to the left side 14 to its home position by action of cam follower 104. The home position of FIG. 10*c* is identical to that home position as shown in FIG. 7*c* prior to the beginning of a second jogging operation during a further partial revolution of the jogger cam 72.

FIGS. 11*a*, 11*b*, and 11*c* illustrate the sheet jogger 10 beginning a second jogging operation. FIG. 11*a* shows the jogger cam 72 which has rotated through a partial revolution on the jogger cam shaft 74 so that the left side guide cam follower 104 has now been biased into the jogging detent 136 of the second curved half 128 of the jogger cam 72. In identical movement as previously described for FIG. 8*b*, FIG. 11*b* shows the back jogger 58 carried by the linkage connection of the slide 60, the link 62, and the rocker arm 100 which connects to the cam follower support 108 and reciprocates the back jogger 58 downward on the jogging deck 12 towards the gate fingers 40 and 42 (not shown) as illustrated by the arrow. FIG. 11*c* shows the left side guide assembly 18 jogging inward to align and justify the longitudinal edges of a stack of sheets against the rear side guide assembly 30 while the back jogger 58 moves downwardly towards the gate fingers 40 and 42 to align and justify the lateral edges of a stack of sheets.

FIGS. 12*a*, 12*b*, and 12*c* illustrate the offset sheet jogging operation of the sheet jogger 10 to offset the aligned and justified bundle of sheets from the preceding bundle of sheets ejected by the sheet jogger 10 as illustrated in FIGS. 7 through 9. Through the further partial revolution of the jogger cam 72 affixed to the jogger cam shaft 74 as shown in FIG. 12*a*, the right side cam follower 106 is biased into the jogging detent 138 of the second curved half 128 of the jogger cam 72 and the left side cam follower 104 leaves the jogging detent 136 to return to its home position on the surface edge of the curved second half 128 thereby returning the left side guide 18 to its home position. The corresponding operation is shown in FIG. 12*c* where the left guide assembly 18 and the right side guide assembly 30 moves towards the left side 14 of the jogging deck 12 of sheet jogger 10. In this same operation as shown in FIG. 12*b*, movement of left side cam follower 104 carries the bar linkage of the cam follower support 108, the rocker arm 100, the link 62, and the slide 60 attached to back jogger 58 to slide back jogger 58 out of slide 98 thereby permitting back jogger 58 to fall out of the way and below sheet jogging deck 12 through the force of gravity. FIG. 12*c* shows the left side guide assembly 18 and right side guide assembly 38 moving towards the left side 14 of the sheet jogging deck 12.

FIGS. 13*a*, 13*b*, and 13*c* illustrate the sheet jogger 10 ejecting a justified aligned bundle of sheets in the offset condition where the left side guide assembly 18 and the right side guide assembly 30 of the sheet jogger 10 are jogged to the left side 14. FIG. 13*a* illustrates the right side cam follower 106 in the jogging detent 138 of the second curved half 128 of the jogger cam 72. FIG. 13*b* shows the cam follower 94 biased into the cam follower eject detent 132 of the hub 124 thereby lowering gate fingers 40 and 42 (not shown) below the jogging deck 12 and raising the lower eject roller 50 which is rotating to propell the justified aligned bundle of sheets off of the jogging deck 12 when the lower eject roller 50 rises up above and comes into contact with the bottommost sheet of a stack of sheets thereby biasing the stack against the upper eject roller 54 rotatably secured to shaft 560 which is affixed to a bracket. FIG. 13*c* shows gate fingers 40 and 42 pulled down below the jogging deck 12 and the eject roller 50 above the jogging deck 12. This sequence of operation is identical to that sequence of operation in FIGS. 9*a* through 9*c* except that the left side guide assembly 18 and right side guide assembly 50 are now offset to the left side 14 of the jogging deck 12 as opposed to being offset to the right side 16 as illustrated in FIG. 9.

FIGS. 14*a*, 14*b*, and 14*c* illustrate the sheet jogger 10 returning to its home position to repeat jogging operations upon another revolution of the jogger cam 72. FIG. 14*a* shows the right side cam follower 106 leaving the jogging detent 138 and returning to its home position; that is, where left side cam follower 104 and right side cam follower 106 are equally spaced apart from hub 124 riding on the edges of first half curved section 126. FIG. 14*b* shows cam follower 94 having risen out of the cam follower eject detent 132 and riding back on first half curved section 126 thereby lowering the lower eject roller 50 below the sheet jogging deck 12. The gate fingers 40 and 42 (not shown) are raised above the sheet jogging deck 12. Further, back jogger 58 is returned to its home position having been pushed out of a slide guide 98 and falling below jogging deck 12 of the sheet jogger 10 which is the same position as that shown in FIGS. 7 and 10. FIG. 14*c* shows the jogger 10 returned to its home position after a complete revolution of the jogger cam 72 and prior to beginning another revolution.

In operation, during the first half revolution of jogging cam 72, left side cam follower 104 enters axial jogging detent 140 which simultaneously causes the left side guide assembly 18 to jog from a home position to the right and the back jogger 58 to jog from its uppermost rest position down slide 60 so that a bundle of sheets on jogging deck 12 is justified against the right side guide assembly 30 and stop fingers 40, 42. As the jogging cam continues to rotate, eject cam follower 94 enters radial eject detent 134 thereby simultaneously raising eject roller 50 and lowering stop fingers 40, 42 so that the justified bundle of sheets is ejected. Thereafter, left side cam follower 104 leaves axial detent 140 thereby simultaneously moving left side guide assembly 18 back to its home position and moving back jogger 58 back to its uppermost position in slide 60 and eject cam follower 94 leaves radial eject detent 134 thereby lowering eject roller 50 and raising stop fingers 40, 42 as cam 72 completes its first half revolution.

As the jogger cam 72 passes through its second half revolution another bundle of sheets is conveyed onto jogging deck 12, and the foregoing jogging actions of left side guide assembly and back jogger 58 to justify the bundle of sheets are repeated as left side cam follower 104 enters axial detent 136. Then, as left side cam follower 104 leaves detent 136, right side cam follower 106 enters axial detent 138, so that the left and right side guide assemblies 18 and 30 move in tandem to the left to offset the justified bundle of sheets. Next, eject cam follower 94 enters radial eject detent 132, eject roller 50 is raised, stop fingers 40, 42 are simultaneously lowered and the offset justified bundle of sheets is ejected. As jogging cam 72 completes one revolution, right side cam follower leaves axial detent 138 and right side guide assembly 30 is moved to the right to its home position and eject cam follower leaves eject detent 132 thereby lowering roller 50 and raising stop fingers 40, 42 in preparation for handling the next bundle of sheets.

Thus, as described above, the movements of the operative elements of the jogging apparatus of the instant invention are all controlled by jogging cam 72. In particular, the left side guide assembly 18 and the back jogger 58 are both controlled by one axial curved surface of jogging cam 72 that includes jogging detents 140 and 136 so that the left side guide assembly 18 and back jogger 58 are actuated twice during a revolution of cam 72. The right side guide assembly is controlled by the other axial curved surface, including jogging detent 138 so that the right side guide assembly is actuated during the second half revolution of jogger cam 72 and moves in tandem with left side guide assembly 18 in order to offset a bundle of sheets prior to ejection. The stop fingers 40, 42 and eject roller 50 are both controlled by radial hub 124 with its eject detents 134 and 132 so that a bundle of sheets is ejected at the end of every half revolution of jogger cam 72.

A stapler or stitcher can be suitably affixed to the sheet jogging deck 12 of the jogger 10 to staple or stitch, the justified aligned bundle of sheets into a secured bundle after jogging operations are finished as shown in FIGS. 8 and 11, but prior to the ejection of FIG. 9 or the offset ejection of FIG. 13. The stapler or stitcher is actuated at the proper time by methods well known in the art such as a timing microswitch which rides on jogger cam 72 at an appropriate location on the curved edge surface 138 of the jogger cam 72. The stapled or stitched bundles are subsequently ejected over staple anvil 76 as previously described.

When sets are stapled, the offset motion described in FIGS. 12*a, b, c* is not generally required and may be disabled by inserting a pin in holes provided in the jogger deck 12 and the right side slide 114 so that the right side guide assembly 30 is held at its home position and does not push the set to the left to its eject position of FIGS. 12*a*, 12*b*, and 12*c*.

The geometrical configuration of the curved circular detented jogger cam 72 controls the movement of the left side guide assembly 18, the right side guide assembly 30, the back jogger 58, gate fingers 40 and 42, and discharge roller 50.

The geometrical placement of curves 138 and 140 determine the operational movement of the left side guide assembly 18 and the back jogger 58. The degree of offset of the right side guide assembly 30 moving to the left side 18 is controlled by the curved edge surface 138 of the jogger cam 72. A knurl knob pin can be placed through a hole, not shown, in the right side guide assembly 30 and the sheet jogging deck 12 to prevent offset movement of the rear side guide assembly if so desired. Further, additional curved detented surface edge may be added to the jogger cam 72 to permit doubling or even tripling jogger action by the left side guide assembly 18 and the back jogger 58.

The shape of the jogger cam 72 determines the mechanical operation of sheet jogger 10. It is considered within the skill of the art to modify the geometrical configuration of the jogger cam 72 to predetermine the mechanical operational order of sheet jogger 10.

Various modifications are contemplated and may obviously be resorted to by those skilled in the art without departing from the spirit and scope of the invention, as hereinafter defined by the appended claims, as only preferred embodiments thereof have been disclosed.

What is claimed is:

1. Jogging apparatus for bringing a plurality of sheets in a stack into a registered bundle comprising:

A. means having an infeed end and an outfeed end for supporting a plurality of sheets;

B. means adjacent said infeed end of said supporting means for conveying said sheets onto said supporting means;

C. means adjacent said outfeed end of said supporting means for registering the leading edges of said sheets;

D. means for jogging the trailing edges of said sheets into registration against said register means;

E. means for jogging the side edges of said sheets into registration;

F. means for discharging said registered bundle of sheets from said outfeed end of said support means, and;

G. unitary cylindrical control means having radial and axial control surfaces, said control means being located below said supporting means for controlling said lead edge register means, said trailing edge jogging means, said side edge jogging means, and said discharging means.

2. Jogging apparatus of claim 1 wherein said conveying means comprises a roller shaft rotatably mounted below said supporting means, roller means affixed to said shaft, and a slot in said infeed end of said supporting means whereby said roller means extends partially through and above said supporting means.

3. Jogging apparatus of claim 2 wherein said roller comprises two spaced rubber rollers fixedly secured to said roller shaft whereby said rollers extend partially through and above said supporting means.

4. Jogging apparatus of claim 3 wherein said supporting means further comprises a first slot in said output end and said lead edge registering means comprises shaft means rotatably mounted below said supporting deck and gate means rotatably mounted to said shaft means and having a finger extending through and above said slot in said outfeed end of said supporting means.

5. Jogging apparatus of claim 4 wherein said supporting means comprises a second slot in said outfeed end of said supporting means and said gates means having a second finger extending through said second slot.

6. Jogging apparatus of claim 5 further comprising a third slot on one of the sides of said supporting means and a gate actuator perpendicularly affixed to said gate means and extending partially through and above said supporting means.

7. Jogging apparatus of claim 4 wherein said discharge means comprises a discharge roller bracket fixedly secured to said gate shaft means, a discharge roller shaft rotatably mounted to said discharge roller bracket, and a discharge roller secured to said discharge roller bracket whereby said discharge roller bracket pivotally carries said discharge roller partially through a fourth slot above said lead edge registering means in said supporting means to discharge a registered bundle of sheets.

8. Jogging apparatus of claim 7 wherein said pivoting movement of said discharge roller bracket carrying said discharge roller partially above said sheet supporting means pivots said gate means away from said supporting means lowering said fingers below said supporting means.

9. Jogging apparatus of claim 1 wherein said supporting means is inclined downwardly from said infeed end toward said outfeed end.

10. Jogging apparatus of claim 1 wherein said trailing edge jogging means comprises a back jogger, a slide rotatably secured to said back jogger, and a link coupled to said back jogger, and a slide cover secured to the underside of said supporting means to cover a longitudinal slot running a partial length of said infeed end of said supporting means whereby said slide cover retains said back jogger which extends partially through and above said supporting means, said slide, and said link in a jogging position and said slide cover permits back jogger to fall below and out of said slide cover by the force of gravity during sheet conveying and discharging.

11. Jogging apparatus of claim 10 wherein said back jogger is movable into said conveying means and below said sheet supporting means.

12. Jogging apparatus of claim 1 wherein said side edge jogging means further comprises a left side guide means and a right side guide means.

13. Jogging apparatus of claim 12 wherein said left side guide means comprises an upper "Z" affixed to a lower "Z", and said lower "Z" is mounted on a plate to form an outer edge of said left side guide means.

14. Jogging apparatus of claim 13 wherein said right side guide means comprises an upper "Z" affixed to a lower "Z" to form an edge of said right guide means.

15. Jogging apparatus of claim 12 wherein said jogging means further comprises a lateral slot in each side of said support means, plastic slides affixed to the underside of said front and rear side, jogging means, cam follower brackets affixed to the underside of said plastic sides, and cam followers rotatably mounted on said brackets whereby said plastic slides confined in place by said lateral slots in said support means permits lateral movement of said front and rear side jogging means.

16. Jogging apparatus of claim 1 wherein said unitary cylindrical control means comprises a cam means.

17. Jogging apparatus of claim 16 wherein said cam means comprises a radial detented hub and one axial circular rim having a curved surface edge mounted to said hub whereby said radial detented hub controls said lead edge register means and said discharing means and said axial curved surface edge controls operation of said trailing edge jogging means and said edge jogging means.

18. Jogging apparatus of claim 17 wherein another axial curved surface edge of said cam means controls said edge jogging means to offset every other registered bundle on discharge from said supporting means.

* * * * *